US007849528B1

(12) United States Patent
Tuday

(10) Patent No.: US 7,849,528 B1
(45) Date of Patent: Dec. 14, 2010

(54) THERAPEUTIC TUB DEVICE

(76) Inventor: Miloslava Tuday, 265 S. LaFayette, Dearborn, MI (US) 48124

( * ) Notice: Subject to any disclaimer, the term of this patent is extended or adjusted under 35 U.S.C. 154(b) by 431 days.

(21) Appl. No.: 12/006,470

(22) Filed: Jan. 4, 2008

(51) Int. Cl.
*E04H 4/00* (2006.01)
*A47K 3/00* (2006.01)
*A47K 3/02* (2006.01)

(52) U.S. Cl. ..... 4/498; 4/559; 4/580

(58) Field of Classification Search ..... 4/498, 4/534, 559, 580
See application file for complete search history.

(56) References Cited

U.S. PATENT DOCUMENTS

| | | | | |
|---|---|---|---|---|
| 158,022 | A | 12/1874 | Bremond | |
| 714,659 | A * | 12/1902 | Batchelder | 4/534 |
| D44,486 | S | 8/1913 | Merry | |
| 3,837,014 | A | 9/1974 | Sugiyama | |
| 4,196,479 | A | 4/1980 | Geisler | |
| 4,340,981 | A | 7/1982 | Vanags | |
| 5,416,931 | A | 5/1995 | Wolfenden et al. | |
| 5,761,750 | A * | 6/1998 | Mazzola et al. | 4/500 |
| 5,926,866 | A | 7/1999 | Chao | |
| 6,071,507 | A | 6/2000 | Zuluaga et al. | |
| 6,430,879 | B1 * | 8/2002 | Nuiry et al. | 52/67 |
| D490,882 | S * | 6/2004 | Shimizu | D23/280.2 |
| 7,310,834 | B2 * | 12/2007 | Karhumaki | 4/540 |
| 2008/0244820 | A1 * | 10/2008 | Moore | 4/498 |

* cited by examiner

*Primary Examiner*—Charles Phillips

(57) ABSTRACT

A therapeutic tub device for receiving water and a person to allow the person to soak in the water includes a tub being filled with water. The tub receives a person to allow the person to soak in the water. The tub is insulated to maintain a temperature of the water in the tub. The tub includes a bottom wall and a perimeter wall extending upwardly from the bottom wall to define an interior space of the tub. An upper edge of the perimeter wall defines an open top end to permit the water and the person to enter the interior space. A telescopic cover is coupled to the upper edge of the tub. The telescopic cover telescopically extends from a foot end of the tub to a head end of the tub to cover the open top end of the tub.

12 Claims, 6 Drawing Sheets

THERAPEUTIC TUB DEVICE

BACKGROUND OF THE INVENTION

1. Field of the Invention

The present invention relates to bathing devices and more particularly pertains to a new bathing device for receiving water and a person to allow the person to soak in the water.

2. Description of the Prior Art

The use of bathing devices is known in the prior art. While these devices fulfill their respective, particular objectives and requirements, the need remains for a device that has certain improved features that allows for the device to be used horizontally and stored vertically minimizing space used during storage. Additionally, the device should including a shroud assembly to extend above a head of a person in the device to shade head and eyes of the person using the device outdoors.

SUMMARY OF THE INVENTION

The present invention meets the needs presented above by generally comprising a tub being filled with water. The tub receives a person to allow the person to soak in the water. The tub is insulated to maintain a temperature of the water in the tub. The tub includes a bottom wall and a perimeter wall extending upwardly from the bottom wall to define an interior space of the tub. An upper edge of the perimeter wall defines an open top end to permit the water and the person to enter the interior space. A telescopic cover is coupled to the upper edge of the tub. The telescopic cover telescopically extends from a foot end of the tub to a head end of the tub to cover the open top end of the tub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
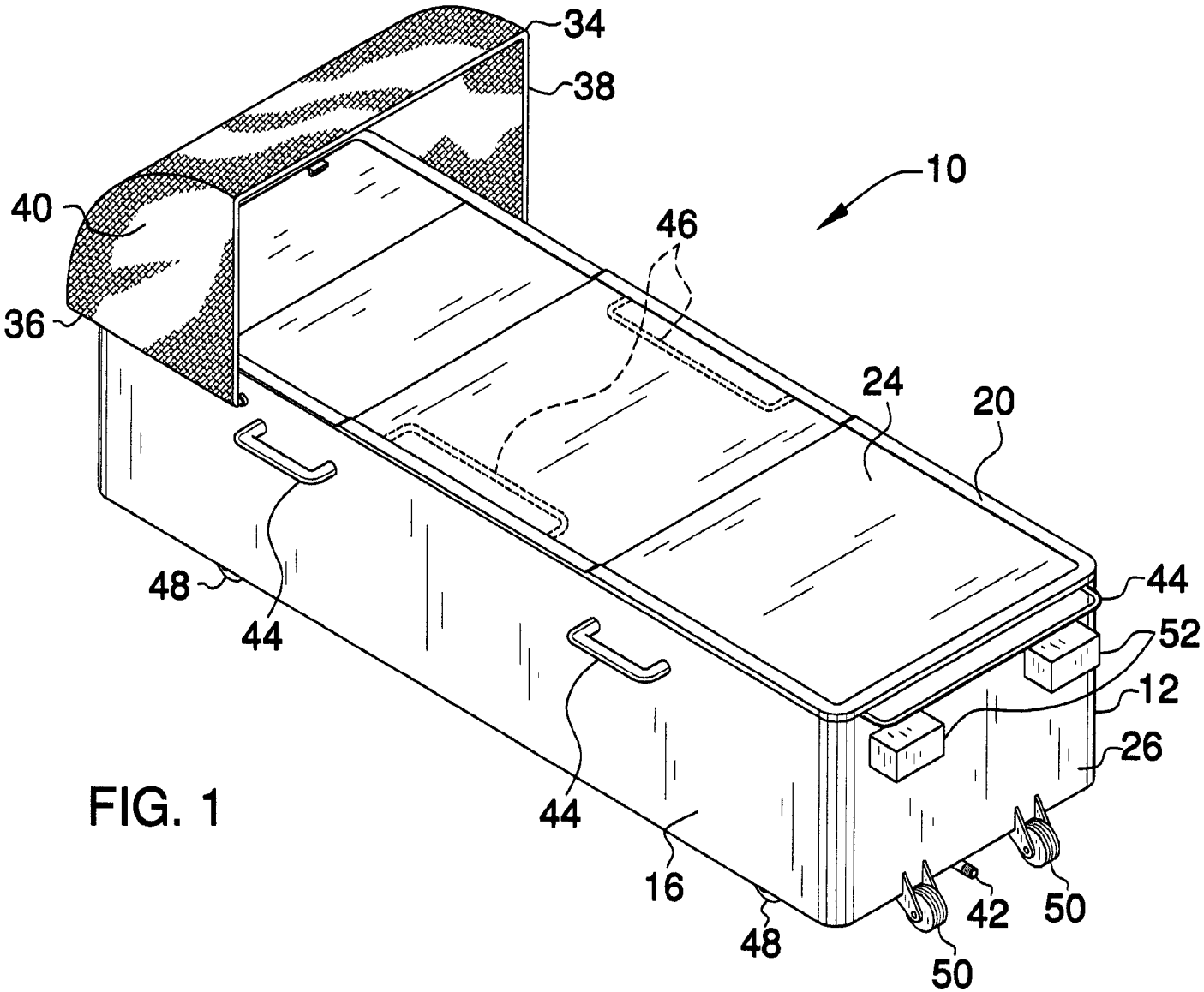
FIG. 1 is a perspective view of a therapeutic tub device according to the present invention.
Figure 2:
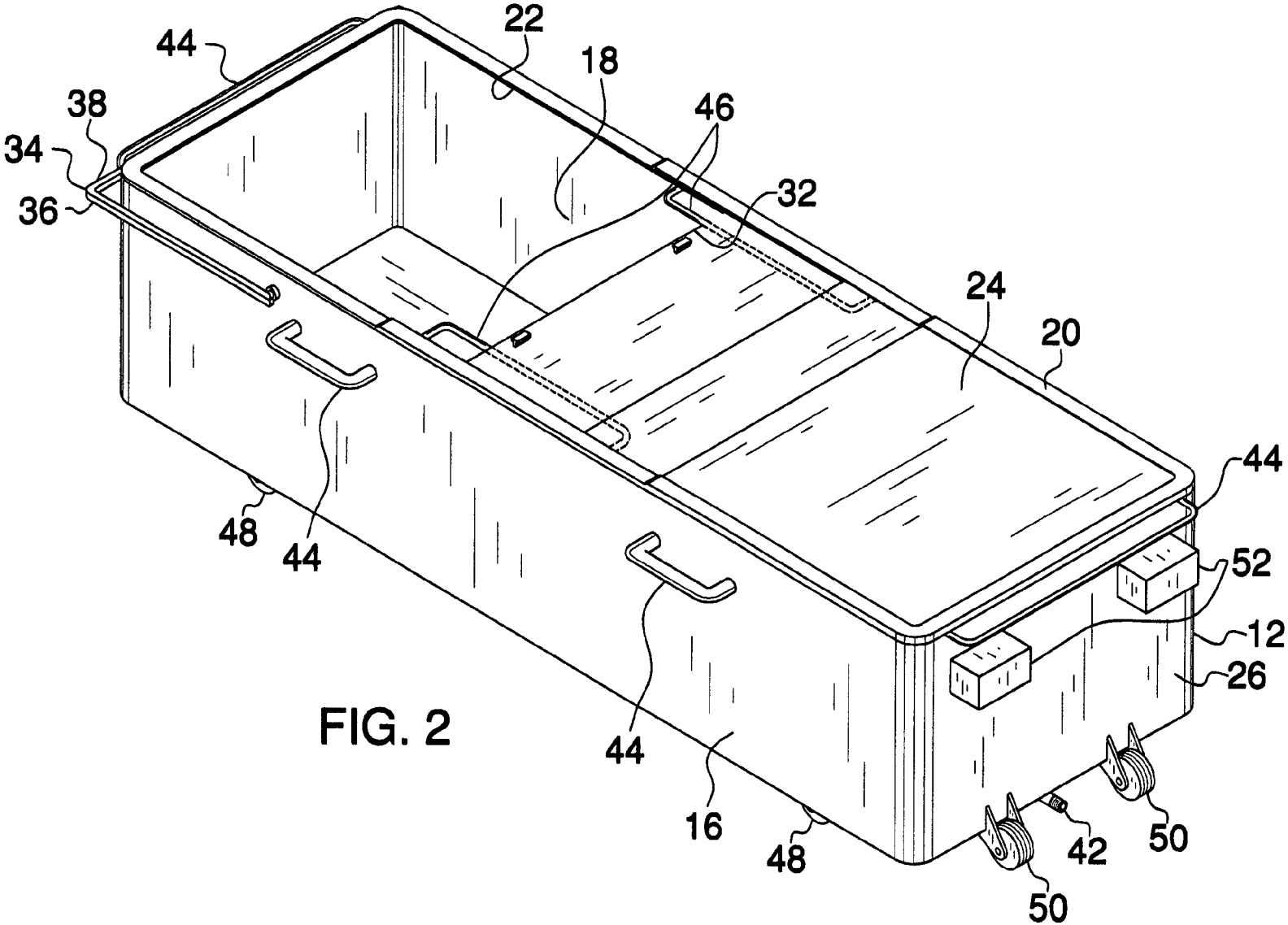
FIG. 2 is a perspective view of the present invention with the telescopic cover partially retracted.
Figure 3:
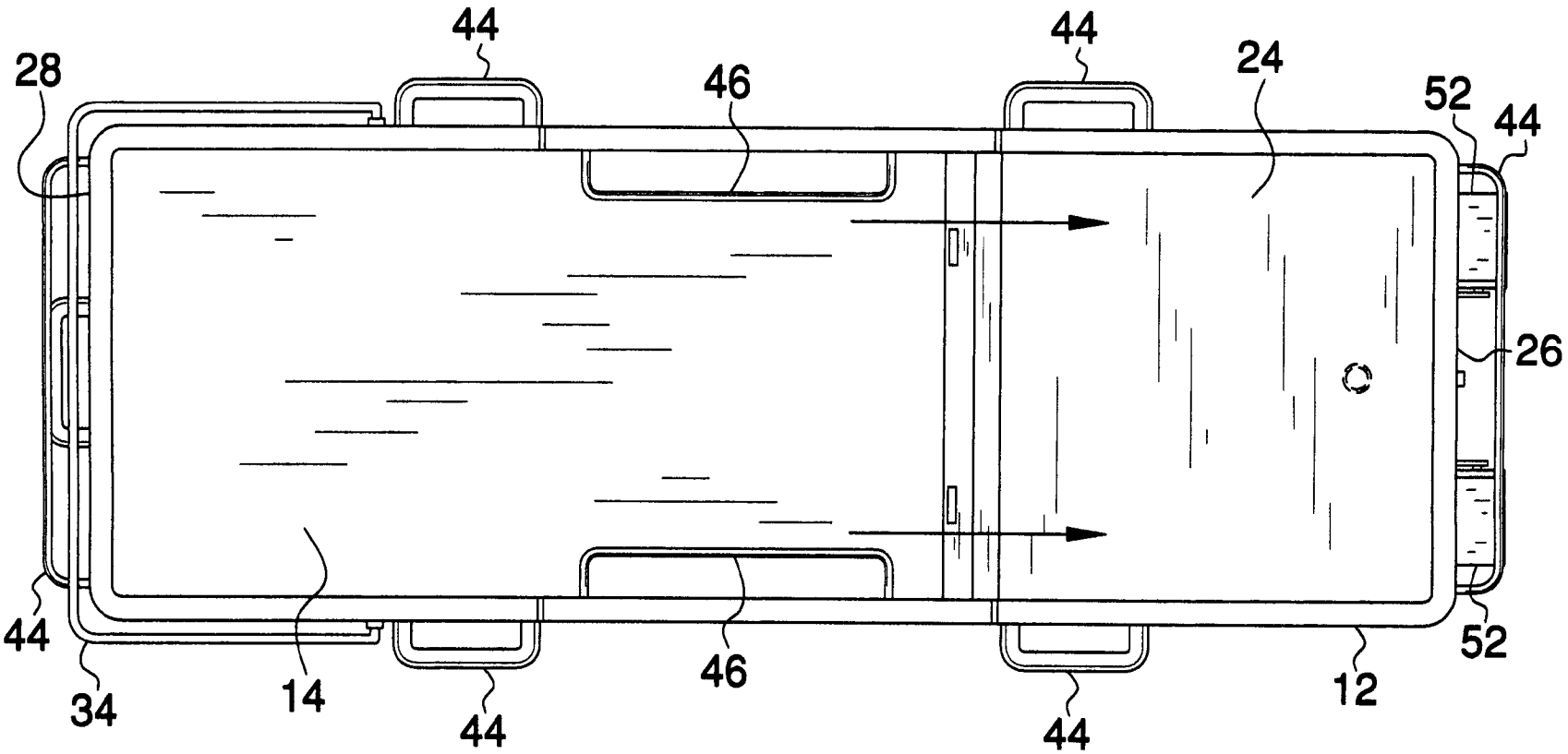
FIG. 3 is a top view of the present invention.
Figure 4:
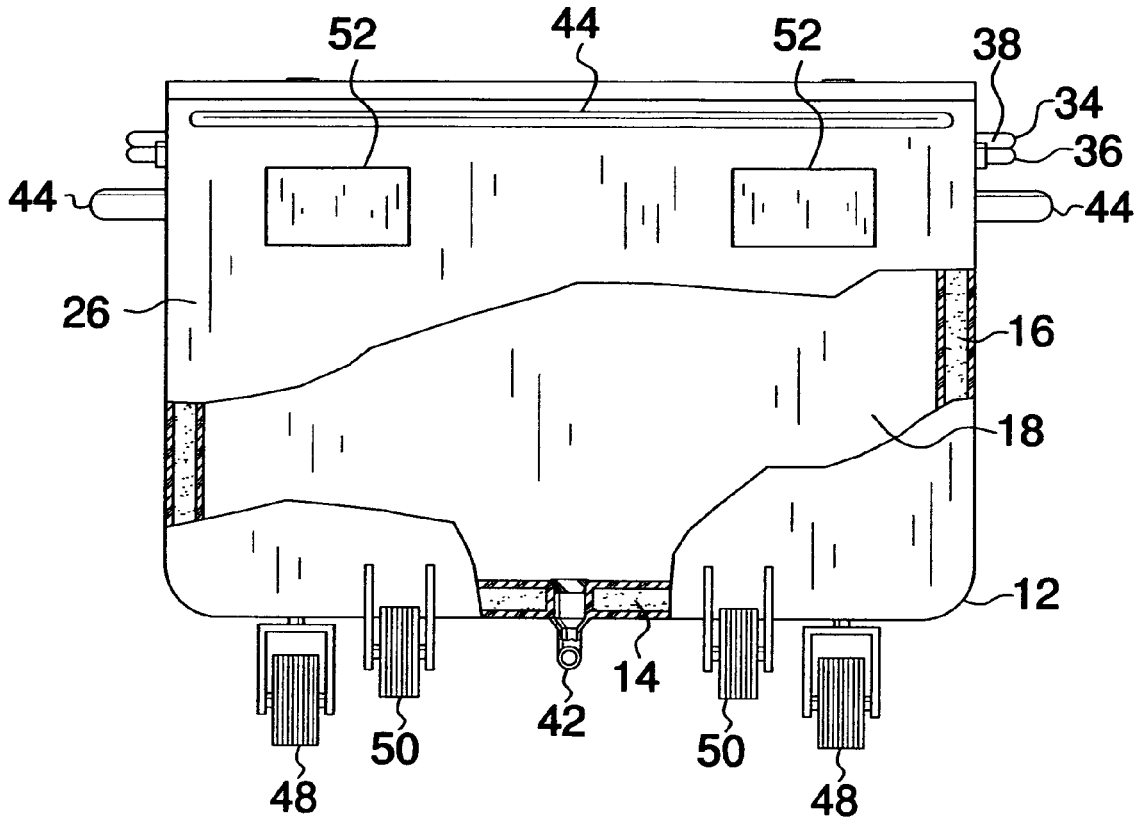
FIG. 4 is an end view of the foot end of the present invention with a portion of the perimeter wall and the bottom wall shown broken away.
Figure 5:
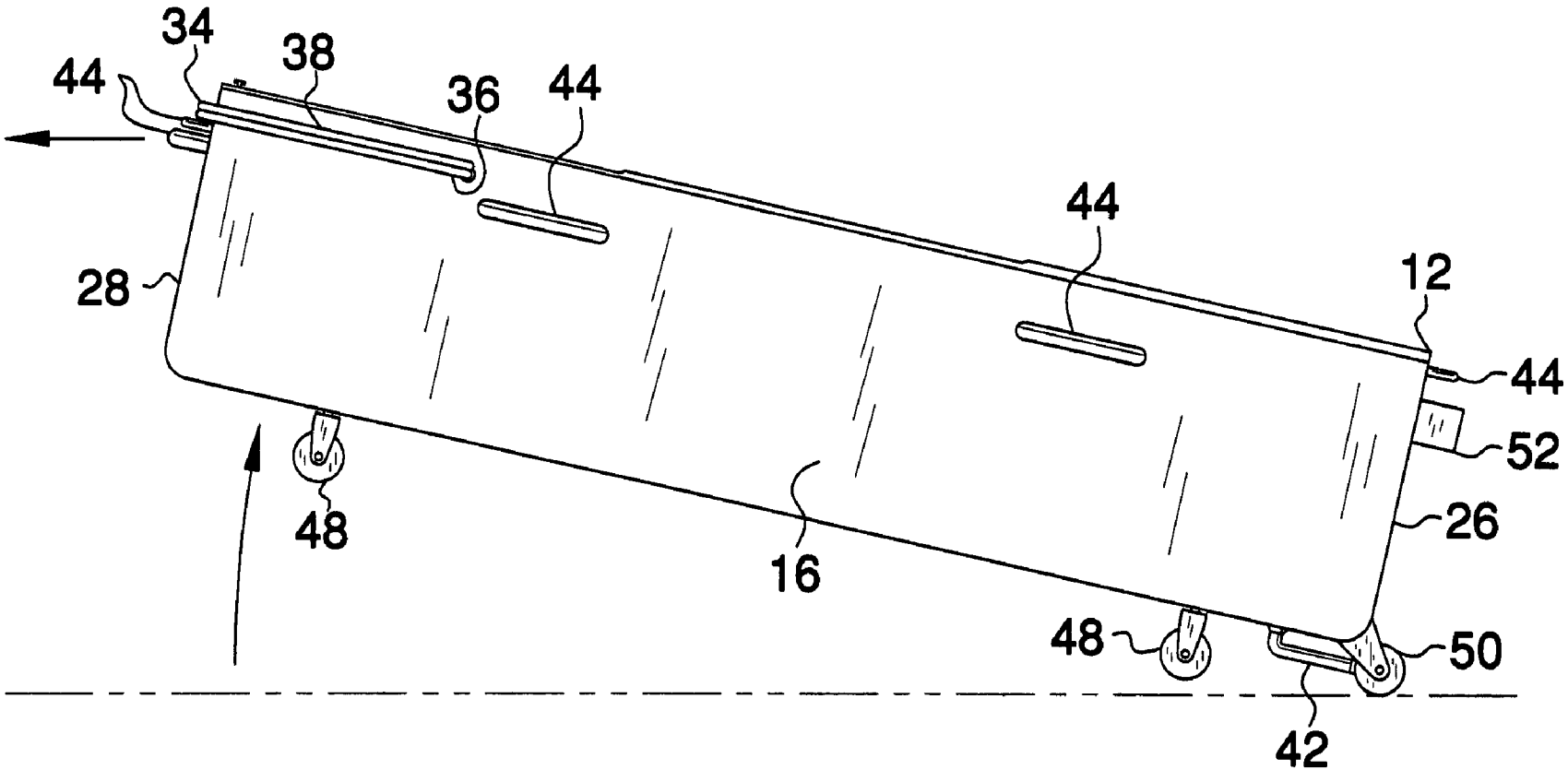
FIG. 5 is a side view of the present invention showing the head end being lifted to position the tube vertically.
Figure 6:
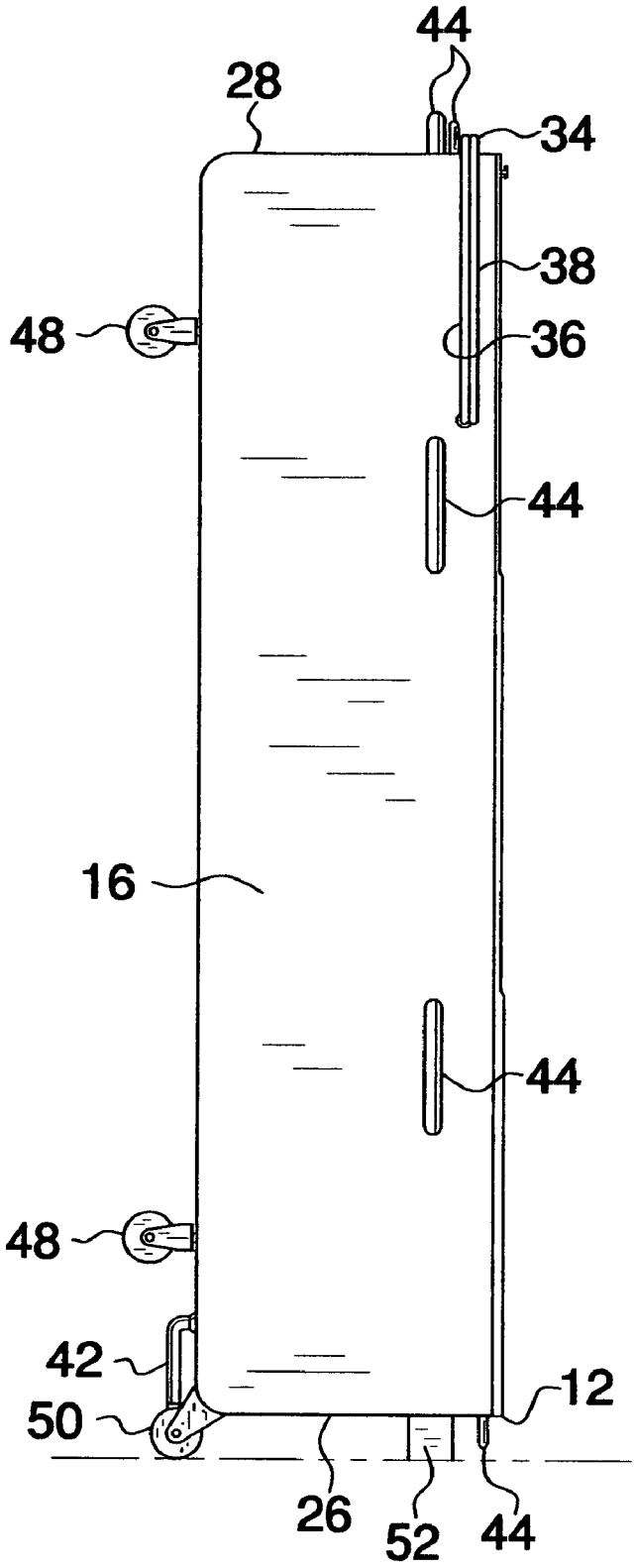
FIG. 6 is a side view of the present invention being positioned vertically.

With reference now to the drawings, and in particular to FIGS. 1 through 6 thereof, a new bathing device embodying the principles and concepts of the present invention and generally designated by the reference numeral 10 will be described.

As best illustrated in FIGS. 1 through 6, the therapeutic tub device 10 generally comprises a tub 12 that may be filled with water. The tub 12 receives the person to allow a person to soak in the water. The tub 12 is insulated to maintain a temperature of the water in the tub 12. The tub 12 includes a bottom wall 14 and a perimeter wall 16 extending upwardly from the bottom wall 14 to define an interior space 18 of the tub 12. An upper edge 20 of the perimeter wall 16 defines an open top end 22 to permit the water and the person to enter the interior space 18. The tub 12 has a length of approximately 6 feet.

A telescopic cover 24 is coupled to the upper edge 20 of the tub 12. The telescopic cover 24 telescopically extends from a foot end 26 of the tub 12 to a head end 28 of the tub 12 to cover the open top end 22 of the tub 12.

A shroud assembly 34 is coupled to the tub 12. The shroud assembly 34 is actuated between a closed position and an open position. The shroud assembly 34 extends above the head of the person when the shroud assembly 34 is in the open position. The shroud assembly 34 includes a lower arm 36 coupled to the tub 12 and an upper arm 38 pivotally coupled to the tub 12. The shroud assembly 34 includes a flexible screen 40 coupled to and that extends between the lower arm 36 and the upper arm 38. The lower arm 36 and the upper arm 38 are approximately parallel to the upper edge 20 of the perimeter wall 16 when the shroud assembly 34 is in the closed position. The upper arm 38 is pivoted to an orthogonal position with respect to the lower arm 36 to stretch the screen between the lower arm 36 and the upper arm 38 and above the head of the person. The tub 12 can be position either indoors or outdoors and the shroud assembly 34 can be used to shade the head and eyes of the person positioned in the tub 12.

A drain pipe 42 is coupled to the bottom wall 14 of the tub 12 and is in fluid communication with the interior space 18. The drain pipe 42 is pluggable to inhibit the water in the tub 12 from draining from the tub 12. The drain pipe 42 is opened to allow the water in the tub 12 to be drained. A plurality of exterior handles 44 is coupled to the perimeter wall 16. The exterior handles 44 are graspable to facilitate moving of the tub 12 to a desire location. Each of the handles is positioned adjacent the upper edge 20 of the perimeter wall 16.

A plurality of interior handles 46 is coupled to the perimeter wall 16 and extends into the interior space 18 of the tub 12. The interior handles 46 are graspable to facilitate entering and exiting of the interior space 18 by the person. Each of the interior handles 46 is positioned adjacent the upper edge 20 of the perimeter wall 16. A plurality of horizontal casters 48 is coupled to the bottom wall 14 and extends between the bottom wall 14 and a support surface. The horizontal casters 48 are rolled across the support surface to facilitate relocation of the tub 12. Each of the horizontal casters 48 is lockable to inhibit rolling across the support surface when the person is positioned in the tub 12.

A pair of vertical casters 50 is coupled to the perimeter wall 16 of the tub 12. The vertical casters 50 are positioned on the foot end 26 of the' tub 12 to allow the tub 12 to be stood vertically to facilitate storage when the tub 12 is not being used. The vertical casters 50 are positioned adjacent the bottom wall 14. A pair of bumpers 52 is coupled to perimeter wall 16. Each of the bumpers 52 is coupled to the foot end 26 of the tub 12. Each of the bumpers 52 engages the support surface to inhibit tipping of the tub 12 when the tub 12 is vertically positioned on the vertical casters 50. The bumpers 52 are positioned adjacent the upper edge 20 of the perimeter wall 16.

In use, the tub 12 is positioned horizontally and the horizontal casters 48 locked to inhibit rolling of the tub 12. The drain pipe 42 is plugged and the interior space 18 of the tub 12 is filled with water that has been heated to a desired temperature. The person positions themselves in the water and pulls the telescopic cover 24 over themselves with their head adjacent to the free edge. After the person has finished in the water and left the water, the drain pipe 42 is positioned adjacent a drain and unplugged to allow the water to drain from the tub 12. To facilitate storage of the tub 12, the head of the tub 12 is lifted and to a vertical position and rolled to desired location on the vertical casters 50. The tub 12 is the stood upright on the vertical casters 50 and the bumpers 52 for storage.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A therapeutic tub device for providing a relaxing environment for a person, said device comprising:

a tub being filled with water, said tub receiving the person to allow the person to soak in the water, said tub being insulated to maintain a temperature of the water in the tub, said tub including a bottom wall and a perimeter wall extending upwardly from said bottom wall to define an interior space of said tub, an upper edge of said perimeter wall defining an open top end to permit the water and the person to enter said interior space;

a telescopic cover being coupled to said upper edge of said tub, said telescopic cover telescopically extending from a foot end of said tub to a head end of said tub to cover said open top end of said tub;

a shroud assembly being coupled to said tub, said shroud assembly being actuated between a closed position and an open position, said shroud assembly extending above the head of the person when the shroud assembly is in the open position, said shroud extending from said perimeter wall upwardly over said interior space, said perimeter wall including a pair of lateral walls extending from said head end to said foot end, said shroud extending upwardly from said perimeter wall along said head end and along a portion of each of said lateral walls when said shroud is in said open position;

said shroud assembly includes a lower arm being coupled to said tub and an upper arm being pivotally coupled to said tub; and said shroud assembly includes a flexible screen being coupled to and extending between said lower arm and said upper arm, said lower arm and said upper arm being approximately parallel to said upper edge of said perimeter wall when said shroud assembly is in the closed position, said upper arm being pivoted to an orthogonal position with respect to the lower arm to stretch said screen between said lower arm and said upper arm and above the head of the person.

2. The device according to claim 1, further comprising a drain pipe being coupled to said bottom wall of said tub and being in fluid communication with said interior space, said drain pipe being pluggable to inhibit the water in the tub from draining from said tub, said drain pipe being opened to allow the water in said tub to be drained.

3. The device according to claim 1, further comprising a plurality of exterior handles being coupled to said perimeter wall, said exterior handles being graspable to facilitate moving of said tub to a desire location.

4. The device according to claim 3, wherein each of said handles is positioned adjacent said upper edge of said perimeter wall.

5. The device according to claim 1, further comprising a plurality of interior handles being coupled to said perimeter wall and extending into said interior space of said tub, said interior handles being graspable to facilitate entering and exiting of said interior space by the person.

6. The device according to claim 5, wherein each of said interior handles is positioned adjacent said upper edge of said perimeter wall.

7. The device according to claim 1, further comprising a plurality of horizontal casters being coupled to said bottom wall and extending between said bottom wall and a support surface, said horizontal casters rolling across the support surface to facilitate relocation of said tub, each of said horizontal caster being lockable to inhibit rolling across the support surface when the person is positioned in said tub.

8. The device according to claim 1, further comprising a pair of vertical casters being coupled to said perimeter wall of said tub, said vertical casters being positioned on said foot end of said tub to allow said tub to be stood vertically to facilitate storage when said tub is not being used.

9. The device according to claim 8, wherein said vertical casters are positioned adjacent said bottom wall.

10. The device according to claim 8, further comprising a pair of bumpers being coupled to perimeter wall, each of said bumpers being coupled to said foot end of said tub, each of said bumpers engaging the support surface to inhibit tipping of said tub when said tub is vertically positioned on said vertical casters.

11. The device according to claim 10, wherein said bumpers are positioned adjacent said upper edge of said perimeter wall.

12. A therapeutic tub device for providing a relaxing environment for a person, said device comprising:

a tub being filled with water, said tub receiving the person to allow the person to soak in the water, said tub being insulated to maintain a temperature of the water in the tub, said tub including a bottom wall and a perimeter wall extending upwardly from said bottom wall to define an interior space of said tub, an upper edge of said perimeter wall defining an open top end to permit the water and the person to enter said interior space;

a telescopic cover being coupled to said upper edge of said tub, said telescopic cover telescopically extending from a foot end of said tub to a head end of said tub to cover said open top end of said tub;

a shroud assembly being coupled to said tub, said shroud assembly being actuated between a closed position and an open position, said shroud assembly extending above the head of the person when the shroud assembly is in the open position, said shroud assembly includes a lower arm being coupled to said tub and an upper arm being pivotally coupled to said tub, said shroud assembly including a flexible screen being coupled to and extending between said lower arm and said upper arm, said lower arm and said upper arm being approximately parallel to said upper edge of said perimeter wall when said shroud assembly is in the closed position, said upper arm being pivoted to an orthogonal position with respect to the lower arm to stretch said screen between said lower arm and said upper arm and above the head of the person;

a drain pipe being coupled to said bottom wall of said tub and being in fluid communication with said interior space, said drain pipe being pluggable to inhibit the water in the tub from draining from said tub, said drain pipe being opened to allow the water in said tub to be drained;

a plurality of exterior handles being coupled to said perimeter wall, said exterior handles being graspable to facilitate moving of said tub to a desire location, each of said handles being positioned adjacent said upper edge of said perimeter wall;

a plurality of interior handles being coupled to said perimeter wall and extending into said interior space of said tub, said interior handles being graspable to facilitate entering and exiting of said interior space by the person, each of said interior handles being positioned adjacent said upper edge of said perimeter wall;

a plurality of horizontal casters being coupled to said bottom wall and extending between said bottom wall and a support surface, said horizontal casters rolling across the support surface to facilitate relocation of said tub, each of said horizontal caster being lockable to inhibit rolling across the support surface when the person is positioned in said tub;

a pair of vertical casters being coupled to said perimeter wall of said tub, said vertical casters being positioned on said foot end of said tub to allow said tub to be stood vertically to facilitate storage when said tub is not being used, said vertical casters being positioned adjacent said bottom wall; and a pair of bumpers being coupled to perimeter wall, each of said bumpers being coupled to said foot end of said tub, each of said bumpers engaging the support surface to inhibit tipping of said tub when said tub is vertically positioned on said vertical casters, said bumpers being positioned adjacent said upper edge of said perimeter wall.

* * * * *